US011769376B1

(12) United States Patent
Acres

(10) Patent No.: US 11,769,376 B1
(45) Date of Patent: Sep. 26, 2023

(54) SYSTEMS AND METHODS FOR REPURPOSING CLASS III ELECTRONIC GAMING DEVICE COMPONENTS FOR USE IN CLASS II ELECTRONIC GAMING DEVICE SYSTEMS

(71) Applicant: James R. Acres, Encinitas, CA (US)

(72) Inventor: James R. Acres, Encinitas, CA (US)

( * ) Notice: Subject to any disclaimer, the term of this patent is extended or adjusted under 35 U.S.C. 154(b) by 0 days.

(21) Appl. No.: 17/070,650

(22) Filed: Oct. 14, 2020

Related U.S. Application Data

(60) Provisional application No. 62/923,732, filed on Oct. 21, 2019.

(51) Int. Cl.
*G07F 17/32* (2006.01)

(52) U.S. Cl.
CPC ..... *G07F 17/329* (2013.01); *G07F 17/3267* (2013.01)

(58) Field of Classification Search
CPC ..... G07F 17/32223; G07F 17/3227; G07F 17/3258; G07F 17/329; G07F 17/3267
See application file for complete search history.

(56) References Cited

U.S. PATENT DOCUMENTS

| | | | | |
|---|---|---|---|---|
| 8,657,679 | B2 | 2/2014 | Nguyen et al. | |
| 8,974,285 | B2 | 3/2015 | Roper et al. | |
| 9,005,005 | B2 | 4/2015 | Powell et al. | |
| 9,039,509 | B2 | 5/2015 | Mullins et al. | |
| 9,275,521 | B2 | 3/2016 | Chang et al. | |
| 9,600,962 | B2 | 3/2017 | Weingardt et al. | |
| 10,078,937 | B2 | 9/2018 | Harvie et al. | |
| 2005/0059467 | A1* | 3/2005 | Saffari | G07F 17/3258 463/19 |
| 2006/0111168 | A1* | 5/2006 | Nguyen | G07F 17/32 463/16 |
| 2017/0154491 | A1* | 6/2017 | Harvie | G07F 17/3227 |
| 2018/0053380 | A1 | 2/2018 | Seymour et al. | |
| 2018/0240299 | A1 | 8/2018 | Grellner | |
| 2020/0027312 | A1 | 1/2020 | Demasters et al. | |

* cited by examiner

*Primary Examiner* — David L Lewis
*Assistant Examiner* — Robert E Mosser
(74) *Attorney, Agent, or Firm* — Quarles & Brady LLP; James J. Aquilina

(57) ABSTRACT

The present invention relates to systems and methods for repurposing existing Class III electronic gaming device components for use in Class II electronic gaming device systems, as the terms "Class II" and "Class III" are defined in the regulations relating to the Indian Gaming Regulatory Act of the United States of America.

20 Claims, 4 Drawing Sheets

SYSTEMS AND METHODS FOR REPURPOSING CLASS III ELECTRONIC GAMING DEVICE COMPONENTS FOR USE IN CLASS II ELECTRONIC GAMING DEVICE SYSTEMS

CROSS-REFERENCE TO RELATED APPLICATION

This application claims domestic benefit under 35 U.S.C. § 119(e) to U.S. Provisional Application No. 62/923,732, filed Oct. 21, 2019, the entirety of which is incorporated herein by reference.

BACKGROUND

The present invention relates to systems and methods for repurposing existing Class III electronic gaming device components for use in Class II electronic gaming device systems, as the terms "Class II" and "Class III" are defined in the regulations relating to the Indian Gaming Regulatory Act which are well understood by those having ordinary skill in the art.

Class III electronic games—which include most electronic slot machines—are very popular in Indian casinos, but are more heavily taxed and regulated than Class II games, which are generally limited to bingo and electronic aids therefor. Accordingly, there is a need for systems and methods that incorporate gameplay elements of a Class III electronic game into a Class II-qualified electronic gaming device system for the purpose of increasing the simplicity and profitability of these systems, while maintaining their popularity with users.

SUMMARY OF THE DISCLOSURE

The Indian Gaming Regulatory Act ("IGRA"), which is codified at Title 25, United States Code, Section 2701 et seq., was enacted by the United States Congress in 1988 to regulate the conduct of gaming on Indian Lands. IGRA established the National Indian Gaming Commission and the regulatory structure for Indian gaining in the United States. The regulatory framework associated with IGRA is found at Title 25, United States Code of Federal Regulations, Part 502. The IGRA and Part 502 of Title 25 of the United States Code of Federal Regulations are incorporated by reference herein as if set forth in their entireties.

IGRA creates a framework in which Indian tribes may engage in three different classes of gaming on their lands. "Class I" gaming consists of "social games played solely for prizes of minimal value" or "traditional forms of Indian gaming when played by individuals in connection with tribal ceremonies or celebrations." 25 CFR § 502.2. Further discussion of Class I games is unimportant to the present disclosure. "Class II" gaming includes bingo games and any "electronic, computer, or other technological aids" used therefor. 25 CFR § 502.2. "Class III" gaming is everything which is not Class I or Class II, including but not limited to any house banking game (e.g., card games such as baccarat and blackjack), slot machines or electronic facsimiles of any game of chance, sports betting, and lotteries. For purposes of the present disclosure, a typical Las Vegas-style slot machine should be considered the paradigmatic Class III gaming device.

Generally speaking, under IGRA, if bingo is legal within a state then Indian tribes are free to engage in Class II gaming within that state. Such gaming is regulated by the tribes themselves according to federal law and without any state involvement, and states do not collect tax revenue from Class II gaming. Class III gaming is treated differently. Under IGRA, if a state engages in some type of Class III gaming then it must negotiate in good faith to establish a framework under which a tribe within that state may also offer that type of Class III gaming. These negotiations usually produce contracts—called "compacts"—between states and tribes, and these compacts typically afford the state some regulatory oversight of tribal Class III gaming, as well as some share of tribal gaming revenue. These shares of gaming revenues are typically in the range of 5% to 10% of gross receipts, and therefore may represent perhaps 30% or more of profit.

Today, the definition of an "electronic, computer, or other technological aid" to bingo can be stretched to encompass a game which, from a player point of view, is indistinguishable from a typical (Class III) slot machine found in a Las Vegas casino. However, the gaming industry was slow to obtain this understanding, and during the 2000s Class II game creators took different paths of game design which resulted in games which were less enjoyable than Class III slot machines. Accordingly, most Indian casinos currently include mostly Class III slot machines—which are heavily regulated and taxed by the states—with only a smattering of Class II slot machines. While many game creators today recognize that one can create a Class II slot machine that plays indistinguishably from a Class III slot machine, replacing the installed base of Class III slot machines would cost tens of billions of dollars and require years of calendar time. These capital and operational costs are prohibitive.

Under IGRA, there are only three required elements for a game to be considered bingo and qualify as a Class II game: 1) The game must be played on cards bearing symbols. 2) The game must be played by matching the symbols on the cards with randomly drawn symbols. 3) Multiple players must compete against each other to be the first player to match the symbols on their card with the game ending pattern. 25 C.F.R. § 502.3(a).

By way of example, a typical bingo card may have twenty-five squares arrayed in five rows and five columns, with each square including a unique number between 1-100. A host randomly draws balls from a ball machine, and each ball has a unique number written on it which corresponds with the 1-100 numerical range. As the host draws balls and calls out numbers, if that number appears on a player's card, the player marks the corresponding square. Play continues until some player marks the two diagonals across the card and calls out "Bingo!," ending the game and winning the game-ending prize.

It is also permissible to pay other prizes before the game-ending prize is won. For example, players may win prizes for completing an entire row or column without ending the game. Such prizes are called "interim prizes," and most prizes awarded in modem Class II games are interim prizes.

As would be understood by those having ordinary skill in the art, "electronic, computer, or other technological" aids to bingo may be used to do everything from drawing balls, to collecting money, to marking cards, to yelling out "BINGO!" This allows for Class II gaming devices and systems to be as fully automated as Class III, Las Vegas-style slot machines.

In summary, the present invention comprises systems and methods for repurposing existing Class III electronic gaming devices or device components for use as "electronic, computer, or other technological" aids in Class II electronic gaming device systems. This repurposing may be performed quickly and in a highly cost-effective manner.

In one respect, the present disclosure comprises a Class II gaming device system comprising at least one component from a Class III gaming device system, the at least one component adapted to function as an electronic, computer, or other technologic aid for the Class II gaming device system.

In another respect, the present disclosure comprises a Class II gaming device system comprising a plurality of Class II gaming devices connected to a Class II bingo server such that data may be communicated between each of the Class II gaming devices and the Class II bingo server, wherein each of the Class II gaming devices comprises at least one component from a Class III gaming device system, the at least one component used with each Class II gaming device being adapted to function as an electronic, computer, or other technologic aid for that Class II gaming device.

In yet another respect, the present disclosure comprises a method of repurposing a Class III gaming device for use in a Class II gaming device system, the method comprising connecting an existing Class III gaming device in data communication with a Class II governor and a Class II bingo server, the Class III gaming device being adapted to function as an electronic, computer, or other technologic aid for the Class II gaming device system, wherein the Class II governor prevents use of the Class III gaming device except for use as an electronic, computer, or other technologic aid for the Class II gaming device system.

BRIEF DESCRIPTION OF THE DRAWINGS

The present disclosure will hereinafter be described in conjunction with the appended drawing figures, wherein like numerals denote like elements.

DETAILED DESCRIPTION OF THE EMBODIMENT(S)

Figure 1:
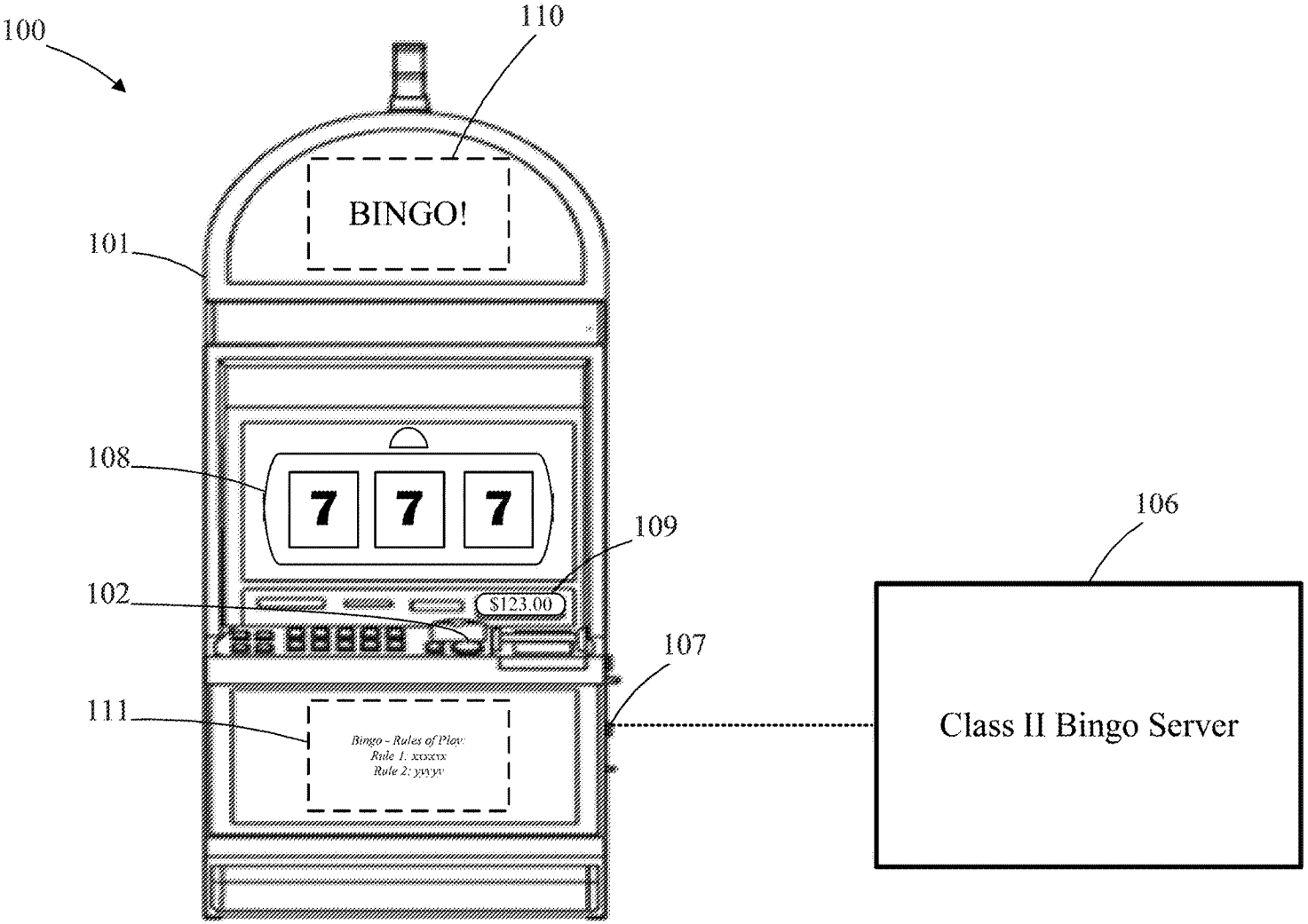
FIG. 1 is a schematic view of a Class II gaming device system which incorporates Class III gaming device components, shown connected to a Class II Bingo Server.

The ensuing detailed description provides exemplary embodiment(s) only, and is not intended to limit the scope, applicability, or configuration thereof. Rather, the ensuing detailed description of the exemplary embodiment(s) will provide those skilled in the art with an enabling description for implementing these embodiment(s). It should be understood that various changes may be made in the function and arrangement of elements of the embodiment(s) without departing from the spirit and scope of the invention, as set forth in the appended claims.

For purposes of the present specification and claims, the terms "Class II" and "Class III" each have the respective meaning as defined in the Indian Gaming Regulatory Act and its accompanying regulations.

As noted above, the present invention comprises systems and methods for repurposing existing Class III electronic gaming devices or device components for use as "electronic, computer, or other technological" aids (hereinafter "electronic aids") in Class II electronic gaming device systems. In effect, both Class II and Class III methodologies of determining the value of prizes that are awarded to players are combined within the same game, in a fashion that maintains the overall classification of the game as Class II under IGRA. In a first step, the Class II methodology is used to determine whether a player has won the game-ending prize or an interim prize. If the player has won an interim prize, then a Class III methodology is used in a second step to determine the value of that interim prize.

The definition of Class II bingo in IGRA has been interpreted by United States federal courts in ways that are very beneficial to Indian tribes. Specifically, federal courts have held that:

- there are no other requirements for Class II bingo games other than those stated in IGRA;
- when determining whether a game is Class II or Class III the constituent components of a game are not analyzed individually, and classification determinations are made as to the entire game;
- multiple players can win "interim prizes" prior to the game-ending prize being won;
- electronic aids can be used by tribes to offer Class II bingo to more players; and
- the Indian canon of construction requires doubts as to whether a game is Class II or Class III be resolved in favor of the tribes.

Using the concepts described above, a physical Class II bingo game will first be described below. Then, Applicant will describe how existing Class III slot machines may be transformed into electronic aids to offer the same bingo game to more casino patrons, with reference to specific embodiment(s) of systems and methods in accordance with the present disclosure.

In one illustrative example, a form of bingo called "Bonus Bingo" is played without electronic aids on a physical bingo card. In this example, players buy physical bingo cards and cover symbols on the cards (e.g., numbers from 1-100) as representations of these symbols (e.g., numbered balls) are randomly drawn. The game-ending prize is won by the first player to score a "blackout" by covering all of the spots on their card.

Since having only one game-ending prize may be boring to players, every player may also win an interim prize, which in one example may be the chance to reach into a grab-bag of prizes being carried around by a bingo hall employee. Players reach into the grab-bag and randomly select a ticket, with each ticket having a prize value written on it. Many of these interim prize values may be zero, but every player can enjoy the excitement of having reached into the grab-bag to draw a ticket with the opportunity to win an interim prize.

Bonus Bingo is a Class II game. It is played by multiple players on bingo cards having symbols with spaces that are covered as bingo symbols are randomly drawn. The first player to cover their entire card ends the game and wins the game-ending prize. The fact that every player also wins an interim prize does not alter the classification of the game. As a physical game, Bonus Bingo has many disadvantages for operators because it is extremely labor-intensive and time-consuming to operate.

In accordance with the present disclosure, existing Class III slot machines may be repurposed as electronic aids to reduce labor, speed play, and/or make a Class II bingo game (e.g., Bonus Bingo) more economically viable for tribal casinos to operate. In summary, the present disclosure describes a methodology to repurpose an existing fleet of Class III slot machines as electronic aids to a Class II bingo game, for example Bonus Bingo. To this end, legacy Class III devices are networked together into a bingo network, and those legacy Class III gaming devices are used as electronic aids to handle money and pay and display prizes.

In an example according to the present system and methods, Bonus Bingo is played on an electronic bingo card having a specific number of squares (e.g., five squares) which each include a unique number in the range of 1-100. The game-ending pattern for the game is covering all squares on the player's card, for example all five squares. In this embodiment, the game also pays interim prizes whenever a single square is covered. The interim prize may be a free play (e.g., free "spin") on what was formerly a Class III slot machine, but is now an electronic aid to the bingo game. In some embodiments, all bingo cards may have a free spot on them, and thus every player covers at least one square and is awarded an interim prize. Accordingly, the player experience on the Class II game according to the present disclosure is indistinguishable from the player experience on the pre-existing Class III game. It should be understood that any form of a Class II bingo or lotto game could be adapted to incorporate legacy Class III components in accordance with the systems and methods discussed herein.

Transforming legacy Class III into components of a Class II gaming system allows casinos to convert existing Class III games into Class II devices at a fraction of the cost of buying a new Class II device, while maintaining existing gameplay experiences within casinos that are known to be enjoyable to patrons. In this fashion, a tribe may convert its entire casino—or large portions thereof—from Class III to Class II virtually overnight, thereby removing both state regulation and state revenue sharing for those games, while minimizing or avoiding the risk of replacing popular games with less popular ones.

In one illustrative example, a piece of hardware we'll call the "bingo box" can modify existing Class III slot machines to prevent stand-alone play, and to repurpose the slot machines as components in an electronically-aided Bonus Bingo (or other Class II bingo or lotto) game.

Bingo boxes connect legacy Class III slot machines to the Bonus Bingo game via the Slot Accounting System ("SAS") protocol, which is a serial communications protocol that is universal to all slot machines used in the United States of America. The bingo box uses SAS to prevent play on the slot machine unless there is an active game of Bonus Bingo being played, in accordance with one of the primary Class II requirements. Once an active game of Bonus Bingo is underway, the bingo box enables the connected slot machines for play.

When a player presses the play button, the bingo box aids the player in marking their electronic bingo card. If a blackout is scored, the bingo box uses SAS to pay the player the game-ending prize (e.g., $1,000).

All players also win an interim "grab-bag" prize. The legacy Class III slot machine is used as an electronic aid to award the grab-bag prize. Just like with grab-bag prizes in a physical bingo setting, some of the prizes in the electronic grab-bag are worth nothing.

If there is no active bingo session available after a blackout is scored, the bingo boxes in each game will prevent all games from being played until a new Bonus Bingo session is available. However, it is anticipated that tribes will be able to seed multiple Bonus Bingo games at all times, thus allowing uninterrupted play by patrons.

Because the legacy Class III slot machines are only used as electronic aids to pay the interim grab-bag prizes, and because these grab-bag prizes can only be obtained through the Class II Bonus Bingo game, the slot machines are transformed from stand-alone Class III games into components of a Class II game, with the entire gaming device system 100 maintaining its Class II qualification.

With reference to the figures, the systems and methods according to the present disclosure will now be discussed, with reference to specific embodiments incorporating these concepts. FIG. 1 is a general schematic view of a Class II gaming device system 100 according to one embodiment of the present disclosure, which comprises a Class II gaming device 101 connected to a Class II bingo server 106. In this embodiment, the Class II gaming device 101 incorporates some Class III gaming device components, which are shown schematically in FIG. 2 and labeled collectively with reference numeral 114. Additional embodiments are contemplated which may use a greater or lesser number of components from one or more existing Class III gaming devices.

Figure 2:
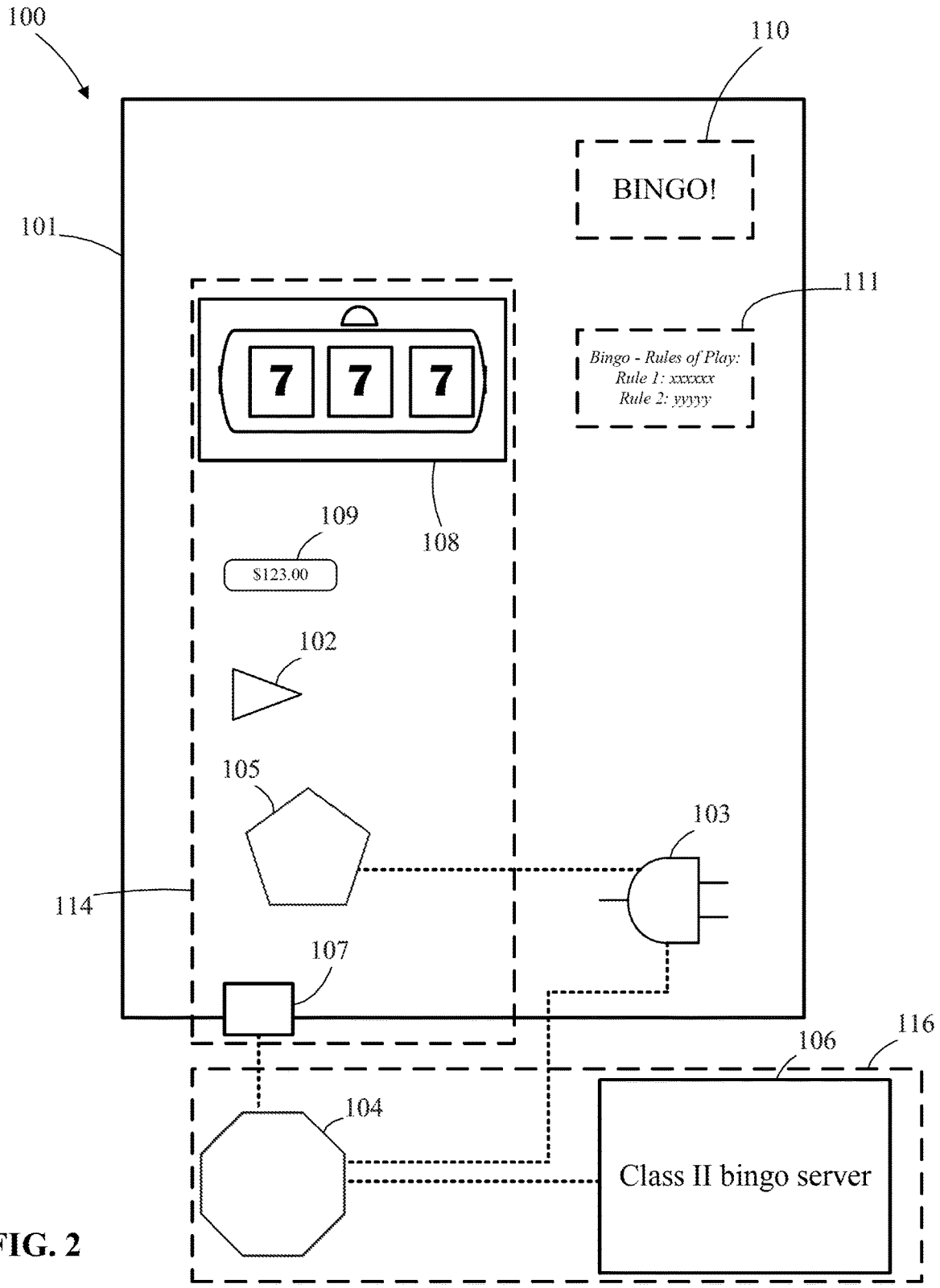
FIG. 2 is a schematic view of the Class II gaming device system of FIG. 1 according to one embodiment of the present disclosure, showing the primary components of the Class II gaming device system and the Class III gaming device components that are being used as electronic aids therein and including a play button diverter circuit.

In one possible embodiment, as shown in FIG. 2, the legacy Class III gaming device play button 102 is connected to a play button diverter circuit 103, which is in turn connected to both the Class II governor 104 and the legacy Class III result engine 105. In this embodiment, the Class II governor 104 is connected to a Class II bingo server 106 and to a legacy Class III gaming device data port 107. In this embodiment, the Class II gaming device 101 also includes a legacy Class III result display 108, a legacy Class III credit meter 109, an optional Class II result display 110, and an optional Class II rules display 111. For ease of illustration, the internal connections between the Class III gaming device components and between the Class III gaming device components 114 and the optional Class II result display 110 and the optional Class II rules display 111 are not shown in FIG. 2, but it should be understood that these components are electrically connected together such that signals may be delivered between these components. In alternative embodiments, either or both of the Class II result display 110 and the Class II rules display 111 may be omitted entirely from the Class II gaming device system 100.

Figure 4:
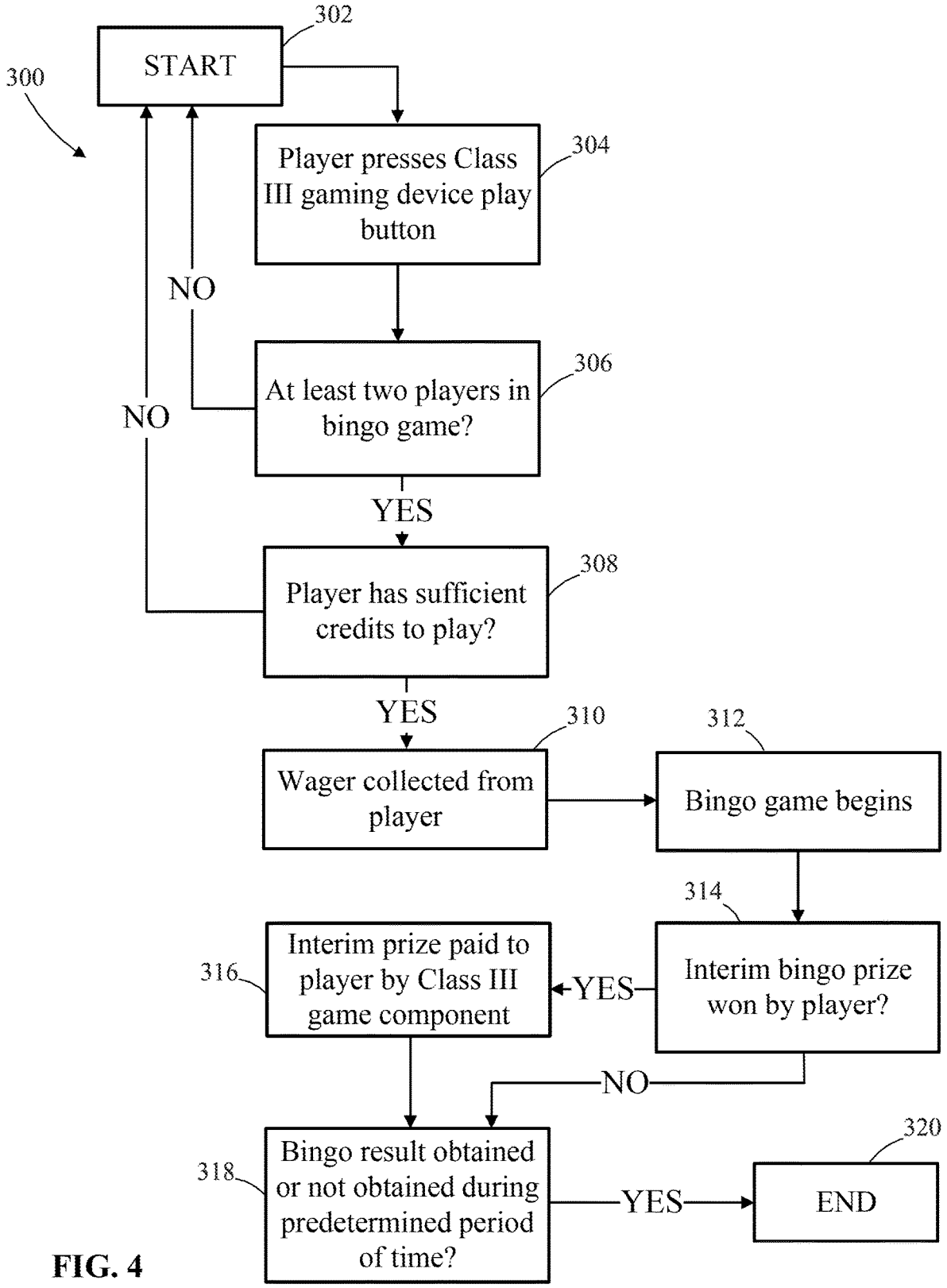
FIG. 4 is a flowchart showing an exemplary method of operating a Class II gaming device system that incorporates legacy Class III game components.

In operation, the Class II gaming device system 100 is offered by a casino for play as an electronic gaming device in a typical fashion. With reference to both FIG. 2 and the flowchart of FIG. 4—which shows an exemplary method 300 of operating a Class II gaming device system incorporating legacy Class III gaming device components in accordance with the present disclosure—when a player presses the legacy Class III gaming device play button 102 to begin the gameplay process (see steps 302 and 304), the play button diverter circuit 103 sends a signal to the Class II governor 104. The Class II governor 104 verifies that there is at least one other player in the bingo game (thus satisfying one of the primary Class II regulatory requirements; see step 306) via its connection with the Class II bingo server 106.

If there is not at least one other player in the bingo game (or waiting to join a bingo game), the Class II governor 104 precludes the Class II gaming device 101 from being operated either via its connection with the legacy Class III gaming device data port 107, or by failing to actuate the Class III result engine 105 via the play button diverter circuit 103.

If there is at least one other player in the bingo game, the Class II governor 104 interrogates the legacy Class III credit meter 109 via the legacy Class III data port 107 to determine whether sufficient credits are available to play the game (see step 308). If insufficient credits are available, the Class II governor 104 optionally informs the player of this fact by actuating the legacy Class III result engine 105 via the play button diverter circuit 103.

If there is more than one player in the bingo game, and there are sufficient credits on the legacy Class III credit meter 109, then the Class II governor 104 causes a wager to be collected from the player of the Class II gaming device 101 (see step 310), either by actuating the legacy Class III result engine 105 via the play button diverter circuit 103, or by decrementing the legacy Class III credit meter 109 via the Class II governor's 104 connection to the legacy Class III gaming device data port 107. The Class II governor 104 then obtains a bingo game result from the Class II bingo server 106 (see step 312). The bingo game result may optionally be displayed on the Class II result display 110.

If any bingo prizes are won (see step 314), they will be awarded by the Class II governor 104 either by actuating the legacy Class III result engine 105 via the play button diverter circuit 103, or by incrementing the legacy Class III credit meter 109 via the legacy Class III gaming device data port 107 (see step 316).

The legacy Class III result display 108 is used to display any bingo prizes awarded by actuating the legacy Class III result engine 105. In addition, the Class II game rules may optionally be displayed via the optional Class II rules display 111.

In this embodiment, the Class II bingo server 106 and the Class II governor 104 are provided in a separate piece of hardware referred to as a "bingo box" 116. The Class II bingo game ends when either a bingo result has been obtained or no bingo result has been obtained during a predetermined period of time (e.g., 5, 10, or 15 minutes; see steps 318 and 320).

Because the systems and methods according to the present disclosure use a pre-existing Class III result engine 105 to provide game results within a Class II gaming device 101, casinos are able to offer a Class II gaming experience to its patrons which is very similar to a pre-existing Class III gaming experience, for example as experienced in the form of free plays on the legacy Class III gaming device components 114 as "interim prizes" which are awarded during the Class II bingo game.

Figure 3:
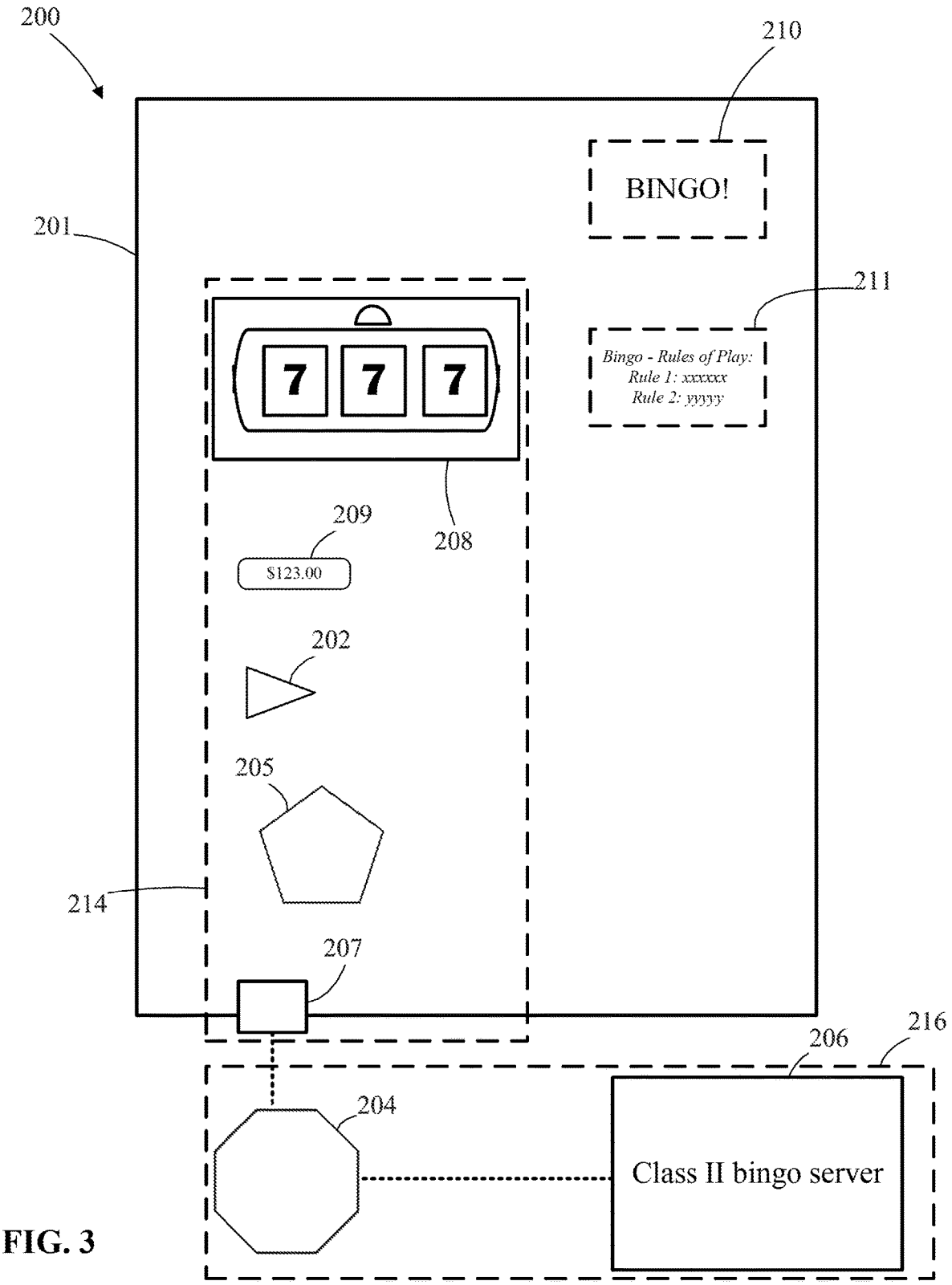
FIG. 3 is a schematic view of the Class II gaming device system of FIG. 1 according to another embodiment of the present disclosure, showing the primary components of the Class II gaming device system and the Class III gaming device components that are being used as electronic aids therein, but excluding a play button diverter circuit.

FIG. 3 is a schematic view of a Class II gaming device system 200, which omits the play button diverter circuit of the embodiment of FIG. 2 but which is otherwise structurally similar thereto, with like parts labeled with reference numerals increased by a value of 100 relative to the embodiment of FIG. 2. Accordingly, some elements that are shared between the embodiments may not be discussed again in detail below. In the embodiment of FIG. 3, the Class II gaming device 201 incorporates some Class III gaming device components, which are shown schematically in FIG. 2 and labeled collectively with reference numeral 214. In the embodiment of FIG. 3, a Class II governor 204 is connected to a Class II bingo server 206 and to a legacy Class III gaming device data port 207. Further, in this embodiment, a legacy Class III play button 202 is connected to the legacy Class III result engine 205, and the Class II gaming device 201 further includes a legacy Class III result display 208, a legacy Class III credit meter 209, an optional Class II result display 210, and an optional Class II rules display 211. For ease of illustration, the internal connections between the Class III gaming device components and between the Class III gaming device components 214 and the optional Class II result display 210 and the optional Class II rules display 211 are not shown in FIG. 3, but it should be understood that these components are electrically connected together such that signals may be delivered between these components.

In operation, when a player presses the legacy Class III gaming device play button 202, the Class II governor 204 verifies that there are at least two players already in the bingo game via its connection with the Class II bingo server 206. If there are not at least two players already in the bingo game (or waiting to join a bingo game), the Class II governor 204 precludes the Class II gaming device 201 from being operated via its connection with the legacy Class III gaming device data port 207.

If the Class II gaming device 201 is not precluded from operation by the Class II governor 204 when a player presses the legacy Class III gaming device play button 202, the Class II governor 204 senses the button press via its connection with the legacy Class III gaming device data port 207 and retrieves a bingo game result from the Class II bingo server 206.

The Class II governor 204 will lock the Class II gaming device 201 through its connection with the legacy Class III data port 207 if a bingo result is not obtained from the Class II bingo server 206 within a certain (predetermined) period of time. The bingo game result may optionally be displayed on the Class II result display 210.

If any bingo prizes are won, they will be awarded by the legacy Class III result engine 205, by incrementing the legacy Class III credit meter 209 via the Class II governor's 204 connection with the legacy Class III gaming device data port 207, or by a casino employee.

The legacy Class III result display 208 is used to display any bingo prizes awarded by actuating the legacy Class III result engine 205. In addition, the Class II game rules may optionally be displayed via the optional Class II rules display 211.

In this embodiment, the Class II bingo server 206 and the Class II governor 204 are provided in a separate piece of hardware referred to as a "bingo box" 216.

Because the systems and methods according to the present disclosure use a pre-existing Class III result engine 205 to provide game results within a Class II gaming device 201, casinos are able to offer a Class II gaming experience to its patrons which is very similar to a pre-existing Class III gaming experience, for example as experienced in the form of free plays on the legacy Class II gaming device components 214 as "interim prizes" which are awarded during the Class II bingo game.

While the principles of the claimed invention have been described above in connection with specific embodiment(s), it is to be clearly understood that this description is made only by way of example and not as a limitation of the scope of the invention, as set forth in the appended claims.

The invention claimed is:

1. A Class II gaming device system comprising:

a Class II electronic gaming device including a legacy Class III gaming device being purpose-built only for Class III gaming adapted to function as an electronic aid for a Class II electronic game implemented via the Class II gaming device system, the legacy Class III gaming device including one or more of a credit meter, a data port, a result display, or a button, wherein functionality of the legacy Class III gaming device is limited to functioning as the electronic aid for the Class II electronic game.

2. The Class II gaming device system of claim 1, wherein the legacy Class III gaming device is adapted to provide an interim prize to a user of the Class II gaming device system.

3. The Class II gaming device system of claim 2, wherein the interim prize is a free play.

4. The Class II gaming device system of claim 1, wherein the legacy Class III gaming device is adapted to mark one or more spaces on an electronic bingo card during use of the Class II gaming device system.

5. The Class II gaming device system of claim 1, wherein the legacy Class III gaming device is adapted to aid in the collection of payments from a user of the Class II gaming device system.

6. The Class II gaming device system of claim 1, wherein the legacy Class III gaming device is adapted to provide a game-ending prize to a user of the Class II gaming device system.

7. The Class II gaming device system of claim 1, further comprising a Class II governor that controls the legacy Class III gaming device by preventing use of the legacy Class III gaming device except for use as the electronic aid for the Class II gaming device system, wherein the Class II governor controls the legacy Class III gaming device using a serial communications protocol.

8. A Class II gaming device system comprising:

a Class II bingo server providing an electronically-aided Bingo game; and a plurality of networked Class II gaming devices communicatively connected to the Class II bingo server, the plurality of networked Class II gaming devices configured to receive data from the Class II bingo server via a serial communication protocol including a Slot Accounting System (SAS) protocol, wherein each of the Class II gaming devices comprises a legacy Class III gaming device being purpose-built only for Class III gaming, the legacy Class III gaming device being adapted to function as an electronic aid for a Class II electronic game implemented via that Class II gaming device, the legacy Class III gaming device including one or more of a credit meter, a data port, a result display, or a button, wherein functionality of the legacy Class III gaming device is transformed such that the legacy Class III gaming device is repurposed to function solely as the electronic aid for a Class II electronic game.

9. The Class II gaming device system of claim 8, wherein each of the Class II gaming devices further comprises a Class II governor connected thereto, the Class II governor being adapted to communicate with the Class II bingo server to determine whether a plurality of users are prepared to commence or already engaged in a Class II game, the Class II governor being further adapted to control the legacy Class III gaming device by preventing use of the legacy Class III gaming device if a plurality of users are not prepared to commence or already engaged in a Class II game.

10. The Class II gaming device system of claim 9, wherein if a plurality of users are prepared to commence or already engaged in a Class II game, the Class II governor of each Class II gaming device is adapted to obtain a bingo game result from the Class II bingo server.

11. The Class II gaming device system of claim 10, wherein the legacy Class III gaming device being adapted for use as a Class II gaming device is adapted to display the bingo game result to a respective user.

12. The Class II gaming device system of claim 8, wherein the legacy Class III gaming device being adapted for use as a Class II gaming device is adapted to provide an interim prize to a respective user.

13. The Class II gaming device system of claim 12, wherein the interim prize is a free play.

14. The Class II gaming device system of claim 8, wherein the legacy Class III gaming device being adapted for use as a Class II gaming device is adapted to mark one or more spaces on an electronic bingo card during use of the Class II gaming device system.

15. The Class II gaming device system of claim 8, wherein the legacy Class III gaming device being adapted for use as a Class II gaming device is adapted to aid in the collection of payments from a respective user of the Class II gaming device system.

16. The Class II gaming device system of claim 8, wherein the legacy Class III gaming device being adapted for use as a Class II gaming device is adapted to provide a game-ending prize to a respective user of the Class II gaming device system.

17. A method of repurposing a Class III gaming device for use in a Class II gaming device system, the method comprising:

connecting a legacy Class III gaming device in data communication with a Class II governor and a Class II bingo server, the legacy Class III gaming device being purpose-built only for Class III gaming, the legacy Class III gaming device being adapted to function as an electronic aid for the Class II gaming device system, and the legacy Class III gaming device including one or more of a credit meter, a data port, a result display, or a button, wherein the Class II governor controls, using a serial communications protocol including a Slots Accounting System (SAS) protocol, the legacy Class III gaming device by preventing use of the legacy Class III gaming device except for use as the electronic aid for the Class II gaming device system.

18. The method of claim 17, further comprising utilizing the legacy Class III gaming device to award an interim prize to a user of the Class II gaming device system.

19. The method of claim 17, further comprising utilizing the legacy Class III gaming device to award a game-ending prize to a user of the Class II gaming device system.

20. The method of claim 17, further comprising connecting the Class II governor to the legacy Class III gaming device via an existing Class III data port located on the legacy Class III gaming device.

* * * * *